US006237806B1

(12) United States Patent
Sala

(10) Patent No.: US 6,237,806 B1
(45) Date of Patent: May 29, 2001

(54) DEVICE TO DISTRIBUTE PHOTOGRAPHIC MATERIAL

(76) Inventor: Giampaolo Sala, Via Padova, 60-30030 Vigonovo (VE) (IT)

( * ) Notice: Subject to any disclaimer, the term of this patent is extended or adjusted under 35 U.S.C. 154(b) by 0 days.

(21) Appl. No.: 09/202,066

(22) PCT Filed: Jun. 9, 1997

(86) PCT No.: PCT/IB97/00666

§ 371 Date: Dec. 8, 1998

§ 102(e) Date: Dec. 8, 1998

(87) PCT Pub. No.: WO97/48017

PCT Pub. Date: Dec. 18, 1997

(30) Foreign Application Priority Data

Jun. 12, 1996 (IT) ..... UD96A0095

(51) Int. Cl.[7] ..... G07F 11/00

(52) U.S. Cl. ..... 221/76; 221/91; 221/120; 221/121; 221/125

(58) Field of Search ..... 221/76, 91, 87, 221/77, 119, 120, 121, 122, 125

(56) References Cited

U.S. PATENT DOCUMENTS

| | | | | |
|---|---|---|---|---|
| 3,107,815 | * | 10/1963 | Wittenborg | 221/120 X |
| 4,498,603 | * | 2/1985 | Wittenborg | 221/76 |
| 5,212,649 | * | 5/1993 | Pelletier et al. | 221/120 X |
| 5,385,266 | * | 1/1995 | Pate | 221/76 |

FOREIGN PATENT DOCUMENTS

| | | |
|---|---|---|
| 234833 | 9/1987 | (EP) . |
| 9315480 | 8/1993 | (WO) . |
| 9515541 | 6/1995 | (WO) . |

* cited by examiner

*Primary Examiner*—David H. Bollinger
(74) *Attorney, Agent, or Firm*—Antonelli, Terry, Stout & Kraus, LLP

(57) ABSTRACT

Device to distribute photographic material, such as photographs, films, negatives, slides, etc., contained in envelopes or wrappers (18), the device comprising structure (12, 13) to interface with and recognise the client accessible from outside and cell-type containing arrangement for the individual envelopes or wrappers (18), the device including at least an aperture (23) for the collection/delivery of the envelope or wrapper (18) accessible from outside and comprising a distribution container organised into one or more sections, each of the sections being individually movable and defining a plurality of containing cells which can be individually selected, the device also comprising a computer unit associated with the structure (12, 13) to interface with and recognise the client, the device comprising an automatic driving mechanism (21, 36) associated to each section of the distribution container (14) to carry the selected containing cell (17) in correspondence with the collection/delivery aperture (23); a closure door (24) driven by an automatic driving mechanism (25), the automatic driving mechanism (25) being activated to open the closure door (24) when the selected containing cell (17) has been driven in correspondence with the aperture (23), the opening of the closure door (24) allowing to the client the direct withdrawal of the envelope (18) contained in the selected containing cell (17); a rectangular-shaped aperture (23) having facing enlargements (123) on two parallel sides of the same to make easier to the client to insert his fingers and so making easier the withdrawal of the envelope (18) from the containing cell (17).

11 Claims, 4 Drawing Sheets

DEVICE TO DISTRIBUTE PHOTOGRAPHIC MATERIAL

FIELD OF APPLICATION

This invention concerns a device to distribute photographic material.

The invention is used to distribute to customers photographic material such as envelopes containing photographs, negatives, films, slides, etc., whether it be new material or material arriving from laboratories or photographic studios after processing has been completed.

STATE OF THE ART

The state of the art covers those commercial enterprises which apart from selling photographic material such as for example blank rolls of photographic film, are also equipped to collect exposed film, negatives, slides or other photographic material to be processed for example developed, printed, enlarged, duplicated, etc., by specialised laboratories or by the appropriate integrated structures, such as for example those known as minilabs.

In these commercial enterprises, the photographic material given in by the client is collected and placed in the appropriate envelopes on which the identification data of the client, and that of the process to which the photographic material is to be subjected, is written manually.

The envelopes are then sent to the place where processing is carried out, and, when the required processes have been completed, the envelopes are then sent back to the commercial enterprises which in turn return them to the clients.

Such commercial enterprises require the continual presence of at least one person to collect the photographic material; this person has to perform a high number of manual operations which are subject to many possible errors such as for example mistaken envelopes, mistaken information concerning the photographic processes required by the client, etc.

In order to limit the presence of the worker, the state of the art includes distribution points, for example in supermarkets, which entrust to the clients the task of collecting the photographic material.

To collect the material, the client has to find the envelope containing his own processed photographic material amongst all those situated in the appropriate display containers.

The distribution points however do not guarantee the client a discreet and confidential management of the photographic material which he has to collect, they do not prevent errors, they are available at times which may not be convenient for all or they may be situated in places which are distant and/or inconvenient to get to. WO-A-89/08901 shows a device to collect and distribute photographic material which has a slot to distribute the identification labels which are to be affixed to the film to be processed, and tickets which the client must keep in order to be able to collect his processed photographic material.

The device comprises housing stations to contain the rolls of film to be processed and the envelopes containing the processed photographic material.

The stations are sub-divided into three distinct sections: one section to house the films, a column for the wrappers, and a section wherein there is a hook to hang the envelopes which have to be delivered.

The delivery procedure is that first the client must be identified, then the correct station with the envelope containing the client's photographic material must be selected.

Then, a current passes through the hook supporting the envelope and melts the plastic of the envelope, making it fall on a slide element which is accessible to the client. This delivery procedure is extremely complex, it requires the seatings to be opportunely conformed so that there is no interference between super-imposed envelopes, the available spaces are very inefficiently filled, the envelopes and their contents may be damaged as they fall onto the slide, all the hooks must be fed with electric current, and other problems, including the need to supply envelopes or wrappers with the appropriately defined structure and size.

WO 90/11582 describes a machine to collect and distribute articles to be processed where the articles are collected by means of a housing unit sub-divided into compartments, each of which can be associated with an envelope or other wrapper containing the processed material.

The mechanism by which the selected envelope is picked up comprises a pair of tracks, one horizontal and the other vertical, by means of which a blade element can be displaced until it is positioned in correspondence with the correct compartment and thus proceed to select the envelope.

Subsequently the blade element is positioned in correspondence with the distribution slide.

The mechanism is very complex, occupies a great deal of space, requires additional drive units, it is delicate and easily prone to break-downs and malfunctions and has management and maintenance problems.

EP-A-234.833 has substantially the same problems since it has an expeller device which acts on the selected envelope and pushes it out, once the correct compartment of one of the rotary housing containers has been positioned in correspondence with the outlet slide to which the client has access.

Where the expeller device is missing, the envelope falls due to the force of gravity onto the outlet slide, which causes problems of possible damage to the envelope and the contents thereof, and also problems of gripping.

Moreover, in the above-described solutions, with the automatic distribution of the envelope, the wrappers must have a defined form and therefore be of substantially standardised size and shape; it is therefore not possible to use wrappers of different shapes and sizes, as happens for example in the case of the distribution of prints, where very different shapes and sizes of material must be delivered inside an envelope which must therefore have different shapes and sizes.

The present applicants have designed, tested and embodied this invention to overcome the shortcomings of the state of the art and to achieve further advantages.

DISCLOSURE OF THE INVENTION

The purpose of the invention is to provide a device to distribute photographic material which will perform, automatically, efficiently and without requiring the continual presence of a worker, those operations carried out by commercial enterprises, such as for example: distributing new photographic material, distributing to clients the processed photographic material and any other possible operations relating to the management of photographic material.

A further purpose of the invention is to provide an extremely simple and solid device, which will not be easily subject to break-downs and malfunctions, which will not need complex and delicate expulsion mechanisms nor involve any danger for the safety of the envelopes or wrappers containing the photographic material or their content.

Another purpose of the invention is to guarantee absolute freedom of choice, within certain constraints of size, regarding the type of wrapper for the product to be distributed, both in terms of shape and size.

A further purpose of the invention is to provide a device which will involve a limited number of manual operations, able to drastically reduce the possibility of human eror and to provide statistics and reports concerning the operations carried out.

Yet another purpose of the invention is to provide a distribution device able to guarantee the client that the above-mentioned operations will be carried out at any time of the day, and that it will be possible to use the device without the direct use of money, by means of credit payment or pre-payment; furthermore, that the service will be available in locations throughout the territory, for example in supermarkets or other places which are commonly frequented by the public, without causing any disturbance to the existing environment.

A further purpose is to accelerate the operations, and thus permit a direct relationship between the client and the processing site, moreover ensuring the client a more discreet and confidential handling of the photographic material than with the systems known to the state of the art.

The invention uses a device, equipped at least with a system to identify the client, comprising a distribution container to deliver to the client the new photographic material and/or processed photographic material arriving from the processing laboratories.

The client-identification system is able to interface with the client so as to recognise univocally the client who has access to the device according to the invention, by means of the appropriate identification means such as tickets, cards, electronic keys or other similar means.

The distribution container, comprising one or more sections, is organised in individual coded locations, to each of which is univocally associated an envelope or wrapper containing the photographic material to be distributed or collected.

The envelope or wrapper carries the client-identification code, so that when the device is loaded by the worker, automatically by means of an optical reader or manually by means of inputting the data by the worker, there is a univocal matching of the coded location inside the device and the client-identification code.

According to a variant, the identification means consist of a label carrying a bar code, a magnetic card or other similar means, which have been delivered to the client, or which are directly associated with the client when the roll of film or other photographic material to be processed is handed over.

According to the invention, the distribution container, or a section thereof, can be moved so as to take an individual coded location in correspondence with a collection/delivery aperture accessible to the client.

According to a variant, the collection/delivery aperture is accessible to the client after a door is activated.

Once the client has been recognised, the coded location has been selected by the device and is in position, and the door, if any, has been opened, the client can collect his envelope or wrapper containing the photographic material, manually.

According to a first embodiment, the distribution container is structured as a plurality of disks, coaxial and super-imposed, each of which radially defines a plurality of coded locations for a single envelope, or a collection of homogeneous envelopes per client, or wrapper to be distributed/collected.

According to a variant, each disk has its own rotary drive means, so as to arrange the selected coded location in correspondence with the aperture which is accessible to the client.

According to another variant, in the event that there is a single door for all the disks defining the distribution container, each disk has an empty or closed location which is positioned in correspondence with the aperture accessible to the client.

In this way, once the coded location has been selected, and only the disk wherein the location is present has been moved, the door opens and allows access only to that coded location, for the desired envelope to be collected.

According to a further variant, every disk is associated with its own door which can be opened.

In another embodiment, the distribution container has a structure with a carousel movement around a substantially horizontal axis, where the envelopes or wrappers are retained by blades.

When the client, and therefore the envelope or wrapper to be selected, has been recognised, the carousel begins to turn and the envelope or wrapper is positioned in correspondence with the collection aperture, from which then the client is able to collect or deliver the photographic material manually.

ILLUSTRATION OF THE DRAWINGS

The attached figures are given as a non-restrictive example and show some preferred embodiments of the invention as follows:

FIG. 1 shows a partial section plane of a first embodiment of the device to distribute photographic material according to the invention;

FIG. 2 shows a part view of the detail A of FIG. 1;

FIG. 3 shows a detail of FIG. 2;

FIGS. 4*a*, 4*b* and 4*c* show the opening sequence of the door of the device of FIG. 1;

FIGS. 5*a*, 5*b* and 5*c* show a view from above of the mechanism of FIGS. 4a–4*c;*

FIG. 6 shows a variant of FIG. 1;

FIG. 7 shows a detail of FIG. 6.

DESCRIPTION OF THE DRAWINGS

In the attached figures, the reference number 10 denotes generally a possible embodiment of a device to distribute photographic material according to the invention.

The client is able to gain access to the device 10 after having inserted his identification card 11 inside the slit 12, associated with the appropriate readers inside, which are not shown here, and possibly formulating a specific request by means of the control panel 13.

Figure 2:
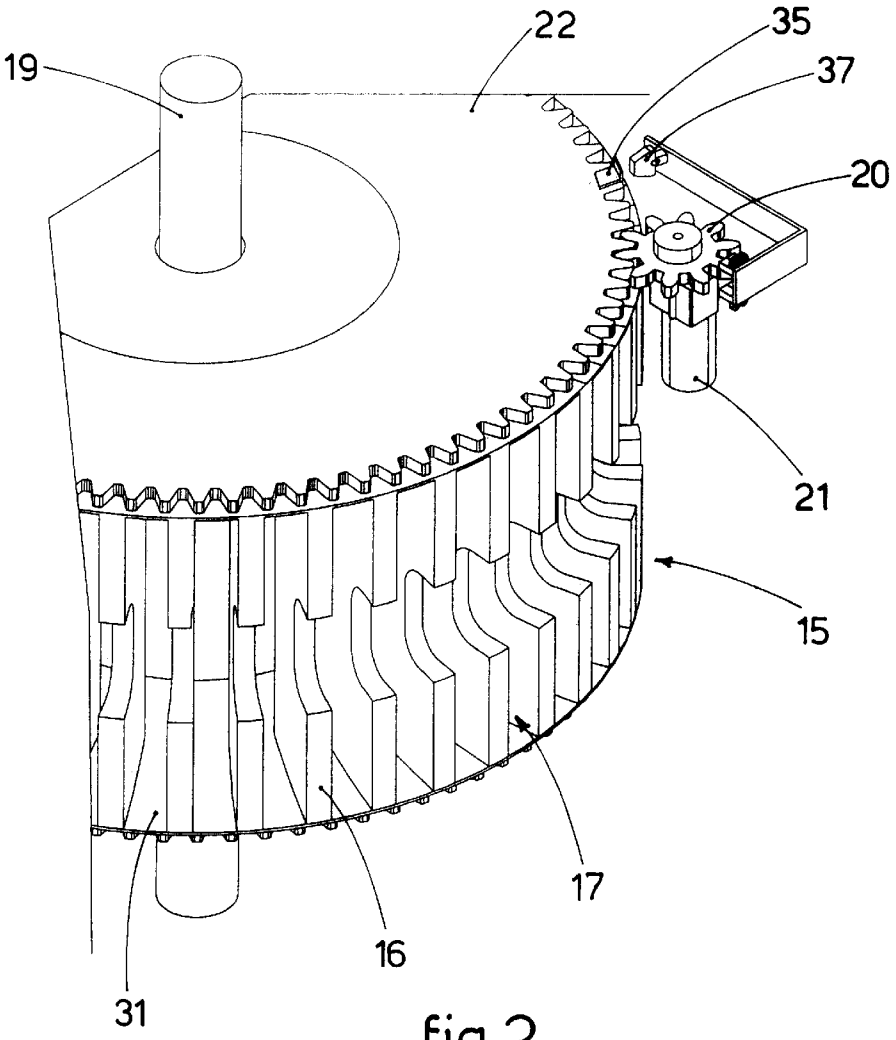
Figure 1:
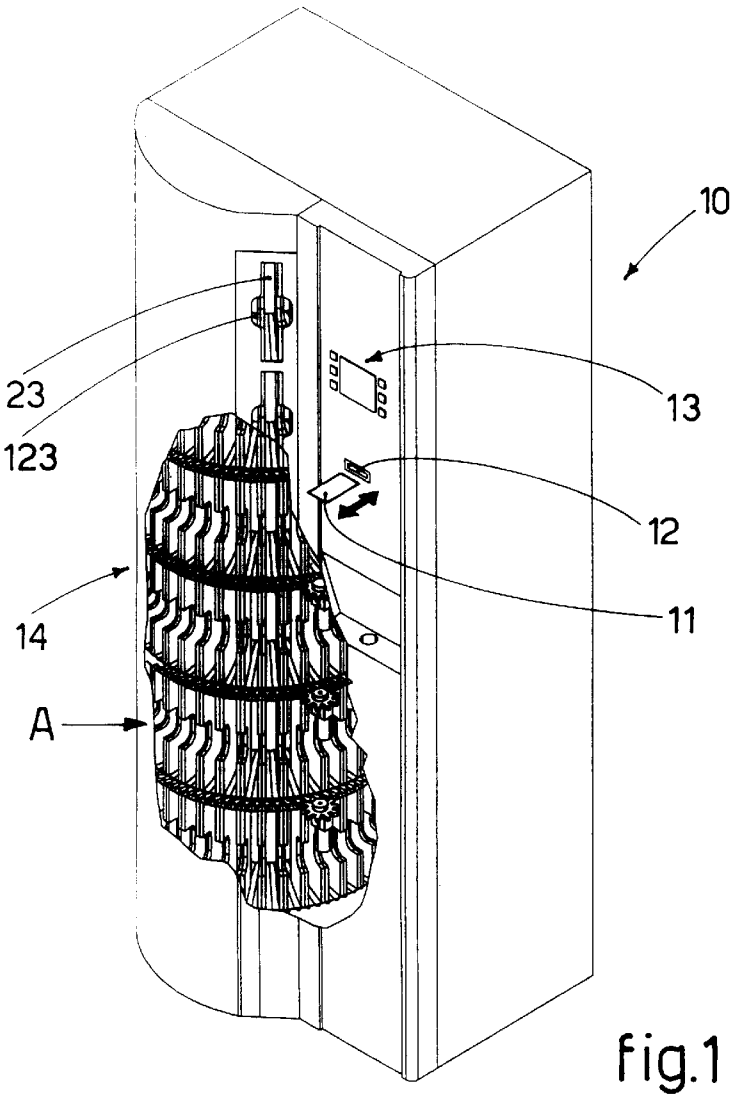
Figure 3:
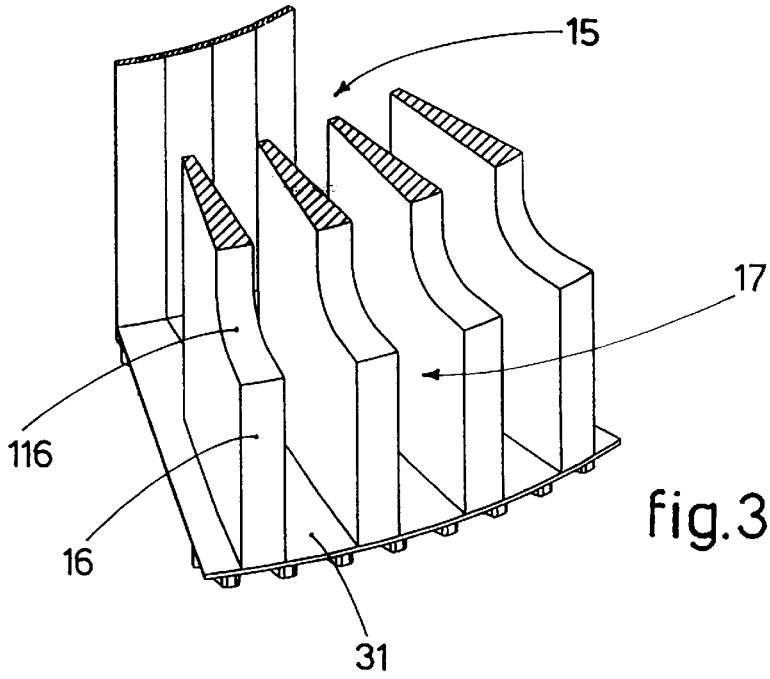

The control panel 13 can also be used by the worker to insert the data of the envelope or wrapper 18 introduced into the device 10 in such a way as to establish a bijective correspondence between the envelope 18 and its position inside the device 10.

In this case, the device to distribute photographic material 10 comprises a distribution container 14 defined by a plurality of disks 15 which are coaxial and super-imposed.

Each disk 15 is sub-divided into circular sectors by means of partitions 16 which identify a plurality of individual containing cells 17 , of such a size as to contain the wrappers 18, in this case envelopes, containing new photographic material or processed material such as rolls, films, slides or other photographic material.

According to a variant, each of the containing cells 17, defined by two adjacent partitions 16 and the base 31, can be univocally identified by a position sensor 37 cooperating with an identification target 38 in zero position, and by sensors placed on the sprocket 20 which monitor the progressive trips as the disks 15 advance.

Each disk 15 can be rotated individually around an axis of vertical rotation, consisting of the shaft 19, to drive a sprocket 20, driven by a motor 21, which engages a gear wheel 22 which is solid with the relative disk 15.

According to a variant, there is a single drive means for all the disks 15, which are equipped with clutch means which are activated selectively so as to allow the rotation only of the selected disk 15.

There is a computer unit inside the device 10 to control and command the drive of the specific disk 15.

The computer unit identifies the client and possibly his request after reading the identification card 11 and any instructions expressed by the client by means of the control panel 13; it recognises on which disk 15 the specific containing cell 17 to be selected is, and consequently activates only the specific disk 15 so as to bring it in correspondence with the collection/delivery aperture 23.

In this case, each disk 15 cooperates with its own aperture 23 and all the apertures 23 are arranged along the height of the device 10, and are substantially aligned vertically.

Disks 15 which are not selected have at least an empty or closed containing cell 17*a* which is positioned in correspondence with the relative aperture 23, making only one containing cell 17 accessible each time the device 10 is driven.

In this case, the specific containing cell 17 is made accessible by the opening of a door 24 which covers all the apertures 23.

When the selected disk 15 has been rotated until the specific containing cell 17 has been positioned in correspondence with the relative aperture 23, the mechanism 25 to open the door 24 is activated.

The mechanism 25 comprises a sprocket 26, driven by its own motor 27, which engages with a gear wheel 28 on which a supporting bar 29 is mounted.

Two articulated arms 30 are connected by one end to the supporting bar 29, and the door 24 is mounted at the other end.

Figure 5A:
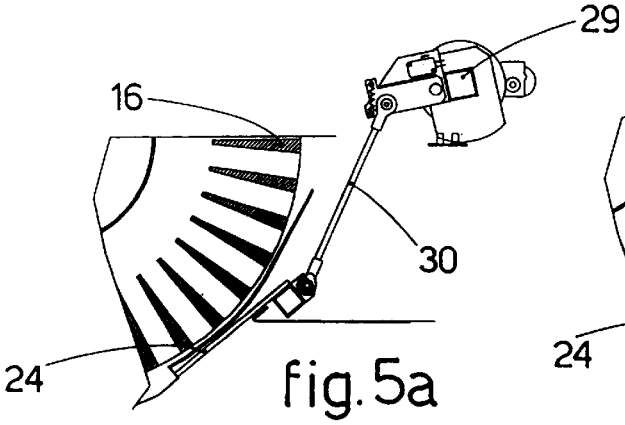
Figures 4A, 4B, 4C:
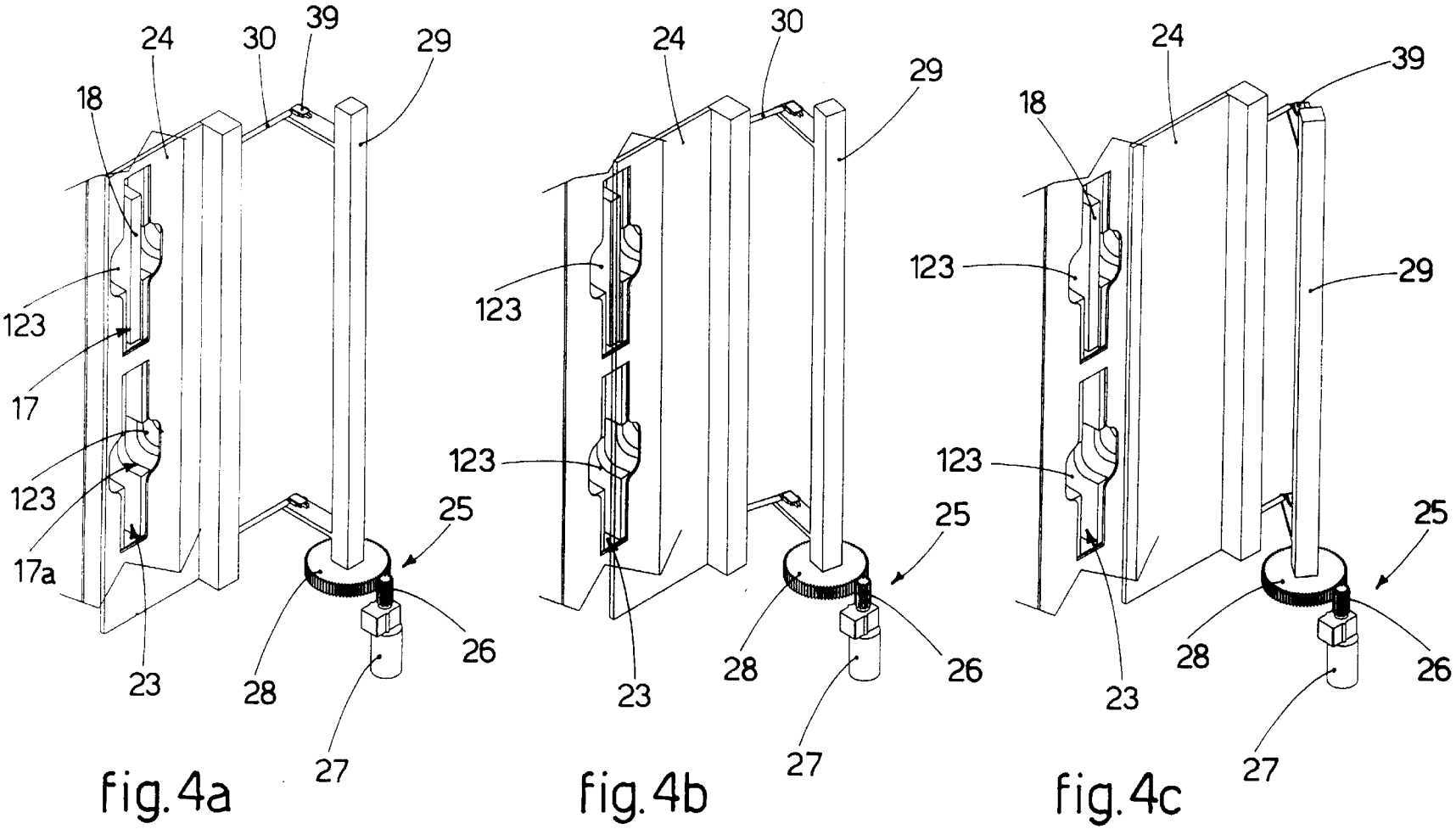

In FIGS. 4*a* and 5*a*, the door 24 completely closes the apertures 23, preventing the client from accessing them and allowing the selected disk 15 to rotate in a condition of complete safety for the client.

Figure 5B:
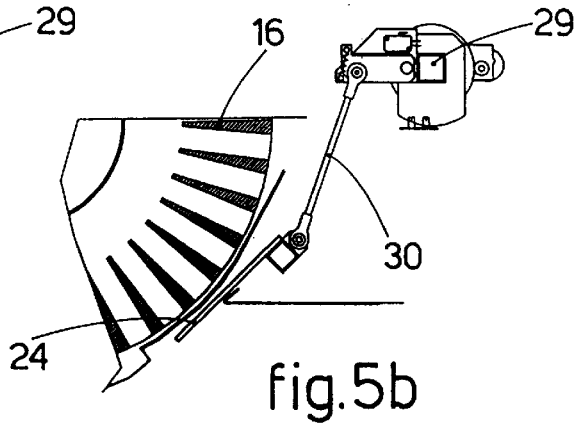
Figure 5C:
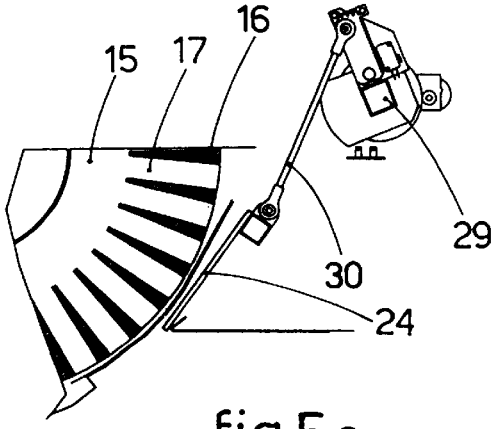

In FIGS. 4*b* and 5*b*, the door 24 is in a partially open position whereas in FIGS. 4*c* and 5*c* the door 24 is completely open, allowing the client to deliver or collect the envelope or wrapper 18 contained in the selected containing cell 17.

As will be seen, the containing cell 17*a* of the disk 15 which is not selected is empty, so that only one containing cell 17 containing photographic material is accessible to the client at a time.

There are safety sensors 39 on the door 24 which stop the closing procedure following the collection of material if the door 24 meets an obstacle while it is closing.

In this case, the apertures 23 have a vertical development with substantially central wider parts 123 so as to enable the client to put in his fingers to collect the envelope or wrapper 18.

For the same reason, the partitions 16 have a hollow 116 in a substantially central position.

Figure 6:
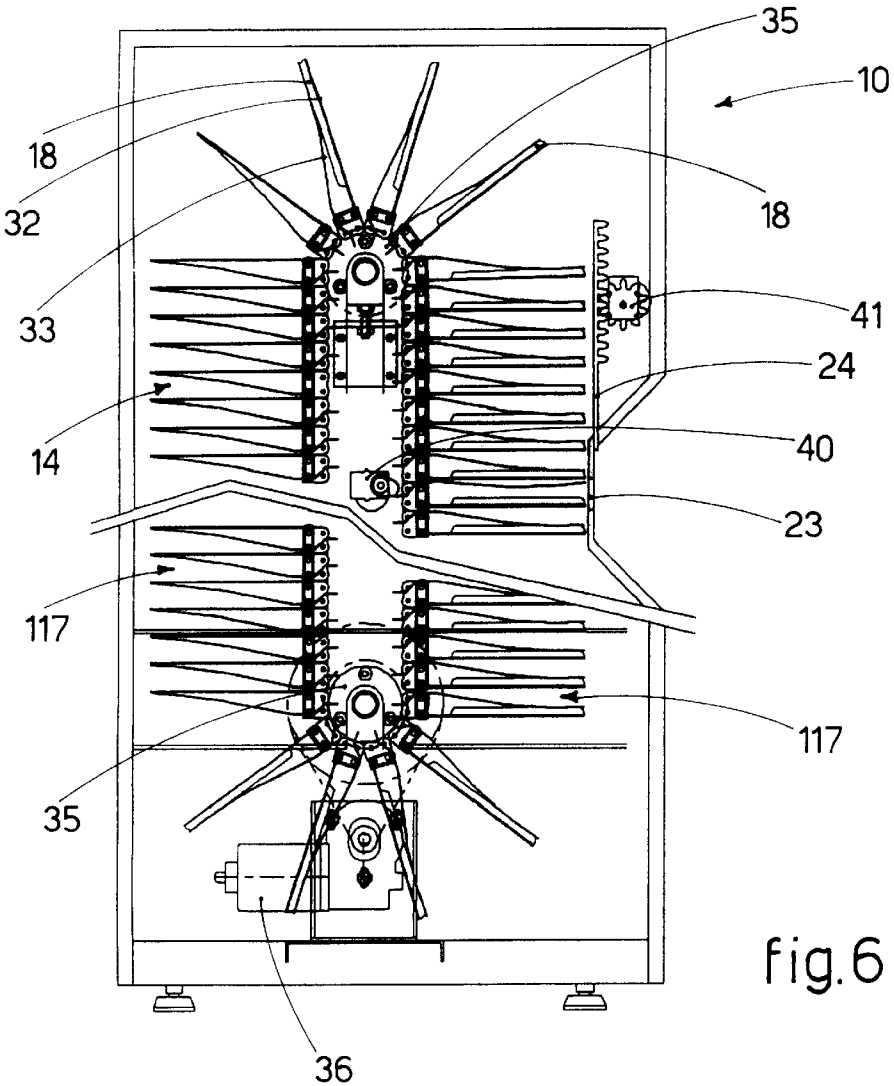

According to the variant shown in FIG. 6, each section of the distribution container 14 has a plurality of containing cells 117 defined by a supporting blade 32 cooperating with an elastic retention fin 33.

The supporting blades 32 are attached by their rear end to a chain 34 which rotates around two pulleys 35 of which one is associated with a motor 36, and which is suitable to make the blades turn substantially like a carousel around a horizontal axis.

The motor 36 is governed by the computer unit.

Once the identification card 11 has been read, and the client has been recognised thereby, the computer activates the motor 36 which takes the desired and selected containing cell 117 in correspondence with the aperture 23, in a similar way as was seen with the previous figures.

In this case, when the cell 117 is positioned in correspondence with the aperture 23, a release mechanism 40 intervenes and acts on the elastic retention fin 33, freeing the envelope and making it available for the client to collect after the door 24 has opened.

Figure 7:
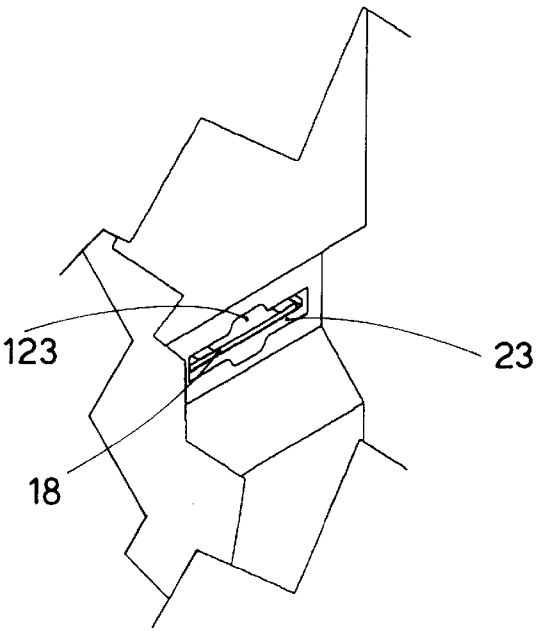

The aperture 23, in this case, is positioned horizontal and has wider parts 123 at the centre of the long sides so that the client is able to insert his fingers (FIG. 7).

When the containing cell 117 has been positioned, the door 24 is activated, in this case raised vertically by the gear mechanism 41; the containing cell 117 is then made available for the client to collect manually the envelope or wrapper 18.

What is claimed is:

1. A device to distribute photographic material contained in envelopes or wrappers to a client, comprising.

means to interface with and recognise the client, the means to interface with and recognise the client being accessible from outside the device, at least one aperture for the collection/delivery of an envelope or wrapper, the aperture being accessible from outside the device, a distribution container organised into one or more sections, each of the sections being individually movable and defining a plurality of containing cells which can be individually selected and which may contain an envelope or wrapper;

a computer unit associated with the means to interface with and recognise the client, drive means associated to each section of the distribution container to carry the selected containing cell in correspondence with the collection/delivery aperture;

a door driven by an automatic driving mechanism, the automatic driving mechanism being activated to open the door when the selected containing cell has been driven in correspondence with the aperture, opening of the door allowing to the client the direct withdrawal of the envelope or wrapper contained in the selected containing cell;

a rectangular-shaped aperture having facing enlargements on two parallel sides of the same to make easier to the client to insert his fingers and so making easier the withdrawal of the envelope or wrapper from the containing cell.

2. The device as in claim 1, in which each of the containing cells defines a space which can be associated with envelopes or wrappers of various shapes and sizes compatible with the size of the cell.

3. The device as in claim 1, in which the at least one aperture comprises a plurality of collection/delivery apertures and the door includes a first closed position wherein the door covers all the collection/delivery apertures for the envelopes or wrappers and at least a second open position wherein it makes at least the aperture associated with the selected containing cell accessible to the outside.

4. The device as in claim 1, in which the at least one aperture comprises a plurality of collection/delivery apertures and the distribution container comprises a plurality of coaxial and super-imposed disks rotating around a substantially vertical axis, each of the disks defining radially a plurality of the containing cells, each of the containing cell being defined by two partitions and a base, the disks being able to be moved individually so as to position the selected containing cell in correspondence with the relative collection/delivery aperture, the partitions including substantially at the centre a hollow functionally mating with the client's fingers for the operations of collection/delivery.

5. The device as in claim 4, in which every disk cooperates with its own collection/delivery aperture, the apertures being super-imposed and substantially aligned vertically.

6. The device as in claim 4, in which a single door element cooperates with all the collection/delivery apertures.

7. The device as in claim 4, in which every disk has at least an empty or closed containing cell arranged, when it is not selected, in correspondence with the relative collection/delivery aperture.

8. The device as in claim 4, in which the door comprises a plurality of door elements and every disk cooperates with its own door element.

9. The device as in claim 1, in which the distribution container comprises one or more sections which can be turned around a substantially horizontal axis.

10. The device as in claim 9, in which each containing cell is defined by a supporting blade cooperating with an elastic retention fin to retain the envelope or wrapper, each of the supporting blades being connected at an end closest to the substantially horizontal axis to a movement chain.

11. A device as in claim 10, which comprises a mechanism to release the elastic retention fin, activated when the selected containing cell is in correspondence with the aperture.

* * * * *